US011008691B2

(12) United States Patent
Garnek et al.

(10) Patent No.: US 11,008,691 B2
(45) Date of Patent: May 18, 2021

(54) LAUNDRY TREATING APPLIANCE HAVING AN AIR FLOW ASSEMBLY

(71) Applicant: WHIRLPOOL CORPORATION, Benton Harbor, MI (US)

(72) Inventors: Marek Garnek, Letanovce (SK); Dusan Heldak, Svit (SK); Crescenzo Iannicelli, Fabriano (IT); Mauro Mancini, Fabriano (IT); Pavol Vasko, Svabovce (SK)

(73) Assignee: Whirlpool Corporation, Benton Harbor, MI (US)

( * ) Notice: Subject to any disclaimer, the term of this patent is extended or adjusted under 35 U.S.C. 154(b) by 77 days.

(21) Appl. No.: 16/395,733

(22) Filed: Apr. 26, 2019

(65) Prior Publication Data

US 2019/0338455 A1 Nov. 7, 2019

Related U.S. Application Data

(60) Provisional application No. 62/666,937, filed on May 4, 2018.

(51) Int. Cl.
*F26B 11/02* (2006.01)
*D06F 25/00* (2006.01)
(Continued)

(52) U.S. Cl.
CPC ..... *D06F 25/00* (2013.01); *D06F 37/06* (2013.01); *D06F 37/266* (2013.01);
(Continued)

(58) Field of Classification Search
CPC ..... D06F 25/00; D06F 37/06; D06F 27/266; D06F 39/024; D06F 58/02; D06F 58/24; D06F 58/26; D06F 2103/54
(Continued)

(56) References Cited

U.S. PATENT DOCUMENTS 5,463,821 A 11/1995 Gauer
7,024,802 B2 4/2006 Myung
(Continued)

FOREIGN PATENT DOCUMENTS

CN 104471142 A 3/2015
CN 104487621 B 4/2017
(Continued)

*Primary Examiner* — John P McCormack
(74) *Attorney, Agent, or Firm* — McGarry Bair PC

(57) ABSTRACT

A combination washing and drying laundry treating appliance for treating laundry according to an automatic cycle of operation includes a cabinet defining a cabinet interior. A tub defines a tub interior for receiving wash liquid during a washing cycle of operation and has at least one baffle with a plurality of air outlets. A drum is rotatable within the tub interior, and defines a treating chamber for holding laundry for washing or drying treatment. A washing circuit comprises a treating chemistry dispenser fluidly coupled to at least one of the tub interior or drum interior and a liquid supply fluidly coupled to at least one of the treating chemistry dispenser, tub interior, or drum interior. A drying air circuit comprises a manifold assembly, a lifter assembly provided on the drum and fluidly coupling the manifold assembly to the plurality of air outlets on the baffle, an air flow assembly having an inlet and an outlet fluidly coupled to the manifold assembly, and a blower fluidly coupled to the air flow assembly whereby actuation of the blower recirculates air through the treating chamber.

20 Claims, 9 Drawing Sheets

(51) Int. Cl.

| | |
|---|---|
| ***D06F 37/06*** | (2006.01) |
| ***D06F 37/26*** | (2006.01) |
| ***D06F 39/02*** | (2006.01) |
| ***D06F 58/02*** | (2006.01) |
| ***D06F 58/24*** | (2006.01) |
| ***D06F 58/26*** | (2006.01) |

(52) U.S. Cl.
CPC ..... *D06F 39/024* (2013.01); *D06F 58/02* (2013.01); *D06F 58/24* (2013.01); *D06F 58/26* (2013.01)

(58) Field of Classification Search
USPC ..... 34/407, 108, 130, 131, 380, 596
See application file for complete search history.

(56) References Cited

U.S. PATENT DOCUMENTS

| | | | | |
|---|---|---|---|---|
| 7,634,925 | B2 | 12/2009 | Lim et al. | |
| 2005/0252029 | A1* | 11/2005 | Kim | D06F 25/00 34/596 |
| 2014/0182159 | A1* | 7/2014 | Shin | D06F 58/04 34/130 |
| 2016/0258107 | A1* | 9/2016 | Hake | D06F 58/206 |
| 2017/0152623 | A1* | 6/2017 | Erickson | D06F 37/268 |
| 2017/0233940 | A1 | 8/2017 | Haselmeier et al. | |

FOREIGN PATENT DOCUMENTS

| | | | | |
|---|---|---|---|---|
| DE | 3918560 | A1 | 12/1990 | |
| DE | 4002809 | A1 * | 1/1991 | D06F 25/00 |
| DE | 4002809 | A1 | 1/1991 | |
| EP | 1832678 | A1 | 9/2007 | |
| EP | 2886708 | A1 | 6/2015 | |
| GB | 2308430 | A | 6/1997 | |
| WO | 9015178 | A1 | 12/1990 | |

* cited by examiner

LAUNDRY TREATING APPLIANCE HAVING AN AIR FLOW ASSEMBLY

CROSS-REFERENCE TO RELATED APPLICATIONS

This application claims the benefit of U.S. Provisional Patent Application No. 62/666,937, filed on May 4, 2018, which is incorporated herein by reference in its entirety.

BACKGROUND

Laundry treating appliances, such as washing machines, combination washer/dryers, refreshers, and non-aqueous systems, can have a configuration based on a rotating drum that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, can be supplied to the treating chamber in accordance with the cycle of operation. In addition, hot air, cold air, or a mixture thereof can be supplied to the treating chamber in accordance with the cycle of operation and via an air flow assembly.

BRIEF SUMMARY

In one aspect, the present disclosure relates to a combination washing and drying laundry treating appliance for treating laundry according to an automatic cycle of operation, the combination laundry treating appliance comprising a cabinet defining a cabinet interior, a tub defining a tub interior for receiving wash liquid during a washing cycle of operation and having at least one baffle with a plurality of air outlets, a drum, rotatable within the tub interior, and defining a treating chamber for holding laundry for washing or drying treatment, a washing circuit comprising a treating chemistry dispenser fluidly coupled to at least one of the tub interior or drum interior and a liquid supply fluidly coupled to at least one of the treating chemistry dispenser, tub interior, or drum interior, and a drying air circuit comprising a manifold assembly provided on a rear of the drum, a lifter assembly provided on the drum and fluidly coupling the manifold assembly to the plurality of air outlets on the baffle, an air flow assembly having an inlet located at a front of the treating chamber and an outlet fluidly coupled to the manifold assembly, and a blower fluidly coupled to the air flow assembly whereby actuation of the blower recirculates air through the treating chamber by flowing air from the front of the treating chamber through the inlet and back to the manifold assembly, where the air is returned to the treating chamber at least through the air outlets in the baffle to establish a front-to-back recirculation of air within the treating chamber.

DETAILED DESCRIPTION

Aspects of the disclosure relate to an air flow assembly for a laundry treating appliance. Laundry treating appliances can be provided with structures and functionality both for washing and drying laundry items within a single appliance. In the case of such a combination washing and drying appliance, in addition to the components provided in a traditional washing machine, additional components for drying laundry items are also provided within the appliance. Non-limiting examples of such drying components include an air flow pathway, including an air inlet and an air outlet to the tub interior, a condenser, a blower, a heating element, and a manifold.

In traditional combination washing and drying machines, drying air can be delivered to the tub interior near a bellows of the laundry treating appliance. However, this can result in poor drying performance for laundry items near the rear of the tub. The present disclosure sets forth a combination washing and drying machine having an air flow assembly in which drying air, heated or not heated, flows through the rear portion of the tub, flows through a manifold and into the lifter assembly, then enters the laundry treating chamber. The drying air exits the tub interior at a front portion of the tub and is routed through a condenser for the removal of moisture, and then through a blower to re-enter the tub interior via the rear portion of the tub. Such an air flow assembly results in improved drying performance for laundry items located at any position within the tub interior.

Figure 1:
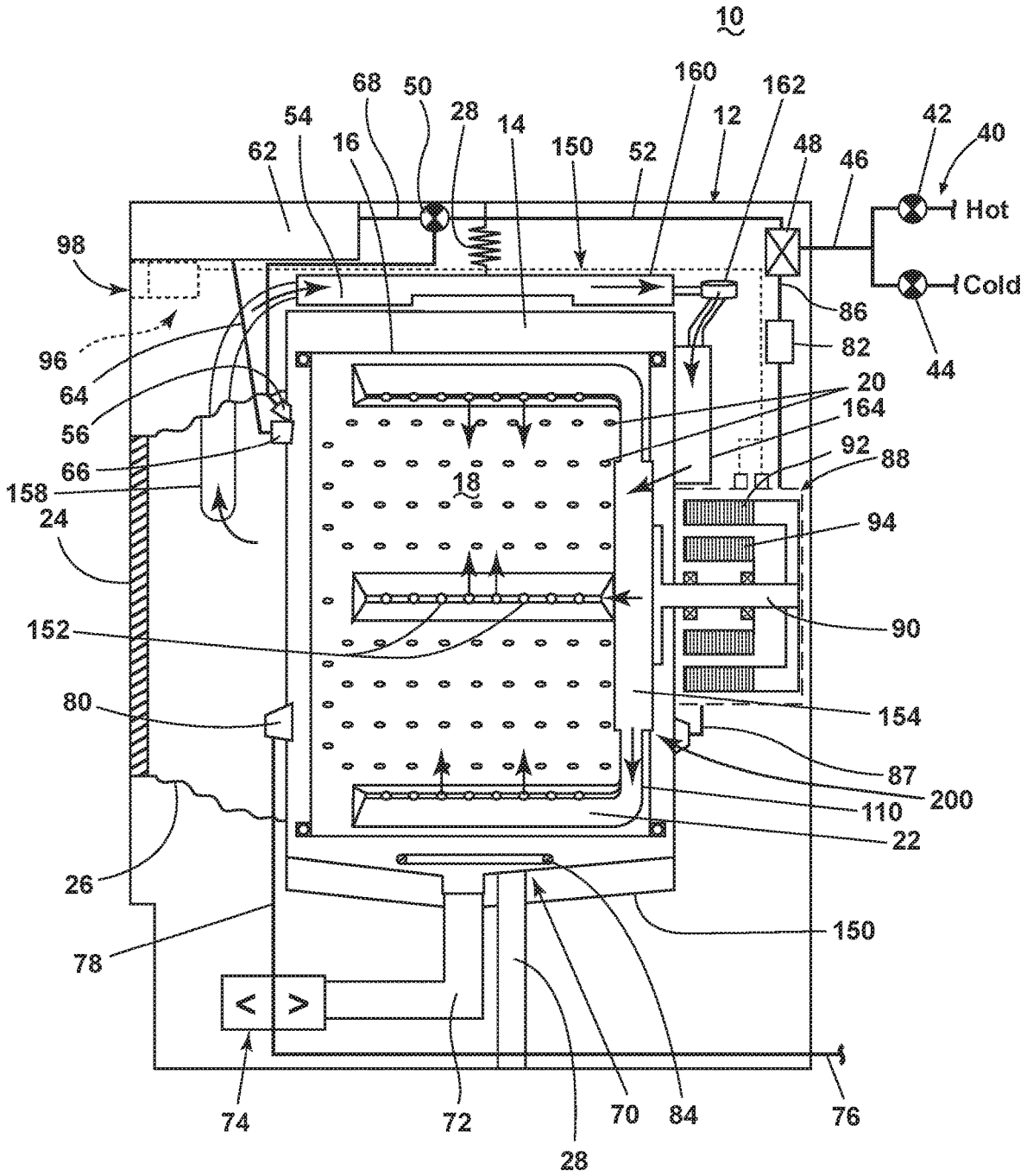
FIG. 1 illustrates a schematic cross-sectional view of a laundry treating appliance in the form of a combination washing and drying machine having an air flow assembly according to an aspect of the present disclosure.

FIG. 1 is a schematic cross-sectional view of a laundry treating appliance according to an aspect of the present disclosure. The laundry treating appliance can be any appliance which performs an automatic cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. While the laundry treating appliance is illustrated herein as a horizontal axis, front-load laundry treating appliance, the aspects of the present disclosure can have applicability in laundry treating appliances with other configurations.

Washing machines are typically categorized as either a vertical axis washing machine or a horizontal axis washing machine. The terms vertical axis and horizontal axis are often used as shorthand terms for the manner in which the appliance imparts mechanical energy to the laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis.

As used herein, the "horizontal axis" washing machine refers to a washing machine having a rotatable drum, perforated or imperforate, that holds laundry items and washes the laundry items. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a washing machine can be top-loading or front-loading. In a top-loading washing machine, laundry items are placed into the drum through an access opening in the top of a cabinet, while in a front-loading washing machine laundry items are placed into the drum through an access opening in the front of a cabinet. If a washing machine is a top-loading horizontal axis washing machine or a front-loading vertical axis washing machine, an additional access opening is located on the drum.

The exemplary laundry treating appliance of FIG. 1 is illustrated as a horizontal axis combination washing and drying machine 10, which can include a structural support system comprising a cabinet 12 which defines a housing within which a laundry holding system resides. The cabinet 12 can be a housing having a chassis and/or a frame, to which decorative panels can or cannot be mounted, defining an interior enclosing components typically found in a conventional washing machine, such as motors, pumps, fluid lines, controls, sensors, transducers, and the like. Such components will not be described further herein except as necessary for a complete understanding of the present disclosure.

The laundry holding system comprises a tub 14 dynamically suspended within the structural support system of the cabinet 12 by a suitable suspension system 28 and a drum 16 provided within the tub 14, the drum 16 defining at least a portion of a laundry treating chamber 18. The drum 16 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. The drum 16 can include a plurality of perforations 20 such that liquid can flow between the tub 14 and the drum 16 through the perforations 20. It is also within the scope of the present disclosure for the laundry holding system to comprise only one receptacle with the receptacle defining the laundry treating chamber for receiving the load to be treated.

The laundry holding system can further include a door 24 which can be movably mounted to the cabinet 12 to selectively close both the tub 14 and the drum 16. A bellows 26 can couple an open face of the tub 14 with the cabinet 12, with the door 24 sealing against the bellows 26 when the door 24 closes the tub 14.

The combination washing and drying machine 10 can further comprise a washing circuit which can include a liquid supply system for supplying water to the combination washing and drying machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 or the drum 16 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The combination washing and drying machine 10 can also be provided with a dispensing system for dispensing treating chemistry to the treating chamber 18 for use in treating the laundry according to a cycle of operation. The dispensing system can include a treating chemistry dispenser 62 which can be a single dose dispenser, a bulk dispenser, or an integrated single dose and bulk dispenser and is fluidly coupled to the treating chamber 18. The treating chemistry dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 62 from the supply conduit 52 by directing the diverter mechanism 50 to direct the flow of water to a dispensing supply conduit 68.

The treating chemistry dispenser 62 can include multiple chambers or reservoirs for receiving doses of different treating chemistries. The treating chemistry dispenser 62 can be implemented as a dispensing drawer that is slidably received within the cabinet 12, or within a separate dispenser housing which can be provided in the cabinet 12. The treating chemistry dispenser 62 can be moveable between a fill position, where the treating chemistry dispenser 62 is exterior to the cabinet 12 and can be filled with treating chemistry, and a dispense position, where the treating chemistry dispenser 62 are interior of the cabinet 12.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The combination washing and drying machine 10 can also include a recirculation and drain system for recirculating liquid within the laundry holding system and draining liquid from the combination washing and drying machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the combination washing and drying machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the combination washing and drying machine 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The combination washing and drying machine 10 also includes a drive system for rotating the drum 16 within the tub 14. The drive system can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction.

The combination washing and drying machine 10 can further comprise a drying system or a drying air circuit for drying laundry items. The drying system comprises a lifter assembly 210 and an air flow assembly 150, which can include a manifold assembly 200, which can be formed by a drum rear portion 156 and a lifter assembly cover 154, the manifold assembly 200 fluidly coupled with the air flow assembly 150. The lifter assembly 210 can be disposed on an inner surface of the drum 16 and can comprise at least one baffle 22 to lift the laundry load received in the treating chamber 18 while the drum 16 rotates. The air flow assembly 150 can be thought of as including the lifter assembly 210 and baffles 22 fluidly coupled to the air flow assembly 150 and the manifold assembly 200. Still further, the air flow assembly 150 comprises a blower 162, a condenser 160, and a heating element 164. The condenser 160 can be provided with a condenser drain conduit (not shown) that fluidly couples the condenser 160 with the pump 74 and the drain conduit 76. Condensed liquid collected within the condenser 160 can flow through the condenser drain conduit to the pump 74, where it can be provided to the recirculation and drain system. In an exemplary aspect, the air flow assembly 150 can be provided adjacent an upper portion of the tub 14, though it will be understood that the air flow assembly 150 need not be provided adjacent an upper portion of the tub 14, and can be provided at any suitable location adjacent the tub 14. The air flow assembly 150 can provide drying air into the treating chamber 18 for drying the laundry items.

In an exemplary aspect, the blower 162 can force drying air past the heating element 164, and through the drum rear portion 156 and the lifter assembly cover 154 of the manifold assembly 200. Drying air can then flow into the lifter assembly 210, into the at least one baffle 22, and into the treating chamber 18 through perforations, illustrated herein as drying air outlets 152 that can be provided on the baffles 22. The now wet air exits the treating chamber 18 via a drum air outlet 158 that is fluidly coupled to the condenser 160. Air exiting the condenser 160 is provided back to the blower 162 to establish a front-to-back recirculation of air from the treating chamber 18.

The combination washing and drying machine 10 also includes a control system for controlling the operation of the combination washing and drying machine 10 to implement one or more cycles of operation. The control system can include a controller 96 located within the cabinet 12 and a user interface 98 that is operably coupled with the controller 96. The user interface 98 can include one or more knobs, dials, switches, displays, touch screens and the like for communicating with the user, such as to receive input and provide output. The user can enter different types of information including, without limitation, cycle selection and cycle parameters, such as cycle options.

The controller 96 can include the machine controller and any additional controllers provided for controlling any of the components of the washing machine 10. For example, the controller 96 can include the machine controller and a motor controller. Many known types of controllers can be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
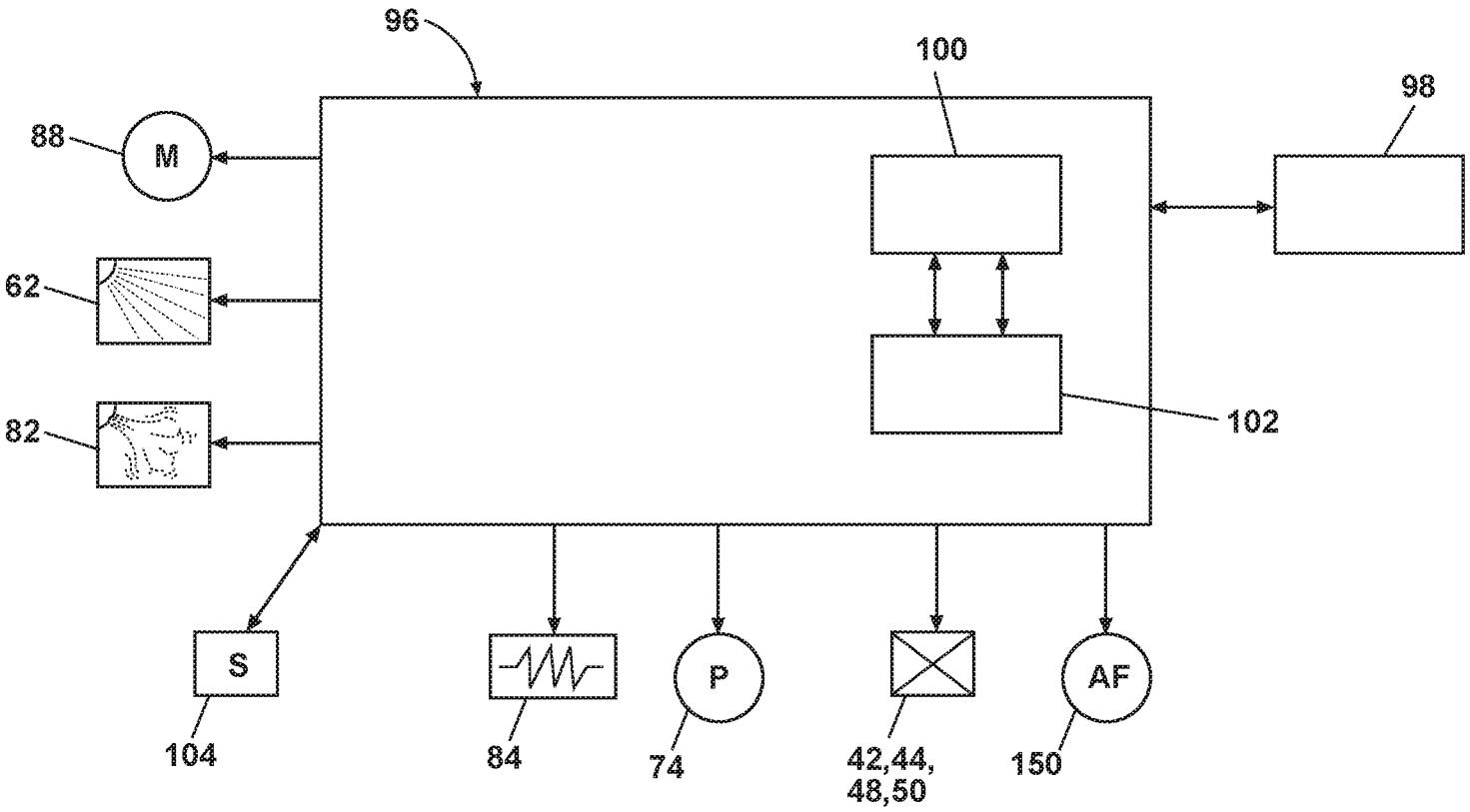
FIG. 2 illustrates a schematic of a control system of the laundry treating appliance of FIG. 1 according to an aspect of the present disclosure.

As illustrated in FIG. 2, the controller 96 can be provided with a memory 100 and a central processing unit (CPU) 102. The memory 100 can be used for storing the control software that is executed by the CPU 102 in completing a cycle of operation using the combination washing and drying machine 10 and any additional software. Examples, without limitation, of cycles of operation include: wash, heavy duty wash, delicate wash, quick wash, pre-wash, refresh, rinse only, and timed wash. The memory 100 can also be used to store information, such as a database or table, and to store data received from one or more components of the combination washing and drying machine 10 that can be communicably coupled with the controller 96. The database or table can be used to store the various operating parameters for the one or more cycles of operation, including factory default values for the operating parameters and any adjustments to them by the control system or by user input.

The controller 96 can be operably coupled with one or more components of the combination washing and drying machine 10 for communicating with and controlling the operation of the component to complete a cycle of operation. For example, the controller 96 can be operably coupled with the motor 88, the pump 74, the treating chemistry dispenser 62, the steam generator 82, the sump heater 84, and the air flow assembly 150 to control the operation of these and other components to implement one or more of the cycles of operation.

The controller 96 can also be coupled with one or more sensors 104 provided in one or more of the systems of the washing machine 10 to receive input from the sensors, which are known in the art and not shown for simplicity. Non-limiting examples of sensors 104 that can be communicably coupled with the controller 96 include: a treating chamber temperature sensor, a moisture sensor, a weight sensor, a chemical sensor, a position sensor and a motor torque sensor, which can be used to determine a variety of system and laundry characteristics, such as laundry load inertia or mass.

Figure 3:
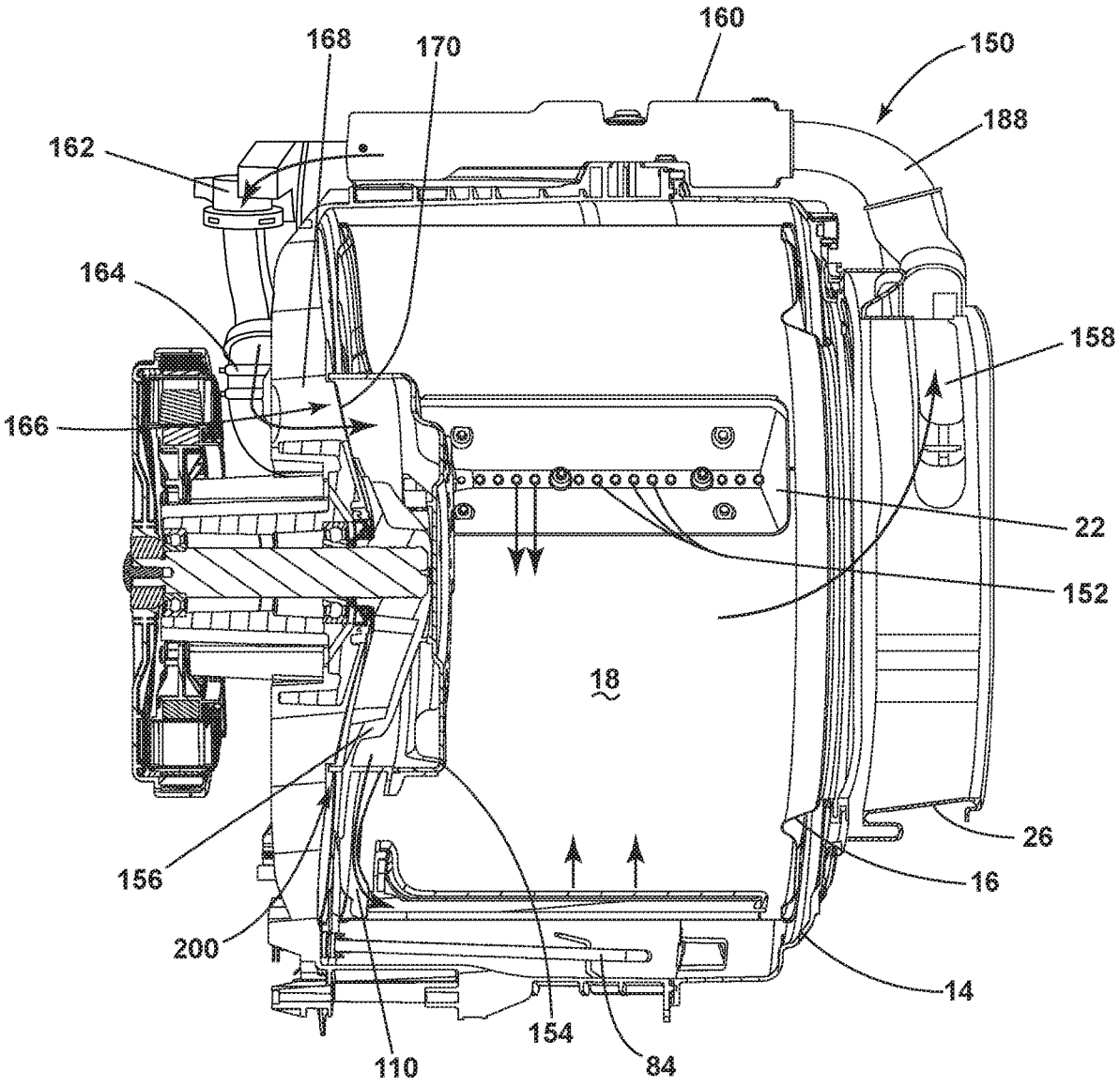
FIG. 3 illustrates a cross-sectional view of the air flow assembly of FIG. 1 according to another aspect of the present disclosure.

Referring now to FIG. 3, a cross-sectional view of the drying system, including the air flow assembly 150, of the combination washing and drying machine 10 is shown. As described previously, the lifter assembly 210 is provided within the treating chamber 18. The lifter assembly 210 can be mechanically coupled to the drum rear portion 156. The lifter assembly 210 can include the lifter assembly cover 154. Just as the baffles 22 can be provided with drying air outlets 152, so can the lifter assembly cover 154 include perforations, illustrated herein as drying air outlets 152. The lifter assembly cover 154 and the drum rear portion 156 can include interior partitions such that they can act as a part of the manifold assembly 200 for directing the drying air to specific baffles 22. In an exemplary aspect, the lifter assembly cover 154 can be formed from plastic.

The drum air outlet 158 can be formed in the bellows 26 to allow drying air that has passed through the treating chamber 18 and absorbed moisture from the laundry items, becoming wet air, to exit the treating chamber 18 and provide an inlet to the air flow assembly 150. A filter or screen (not shown) can be provided within or adjacent to the drum air outlet 158 for filtering lint and dust that is carried with the drying air exiting the treating chamber 18. The filter can be provided in a location such that it is accessible to the user for cleaning after the drying cycle is completed.

The drum air outlet 158 is fluidly coupled to the condenser 160 that is provided within the air flow assembly 150 via an exhaust duct 188. Downstream of the condenser 160 is the fluidly coupled blower 162. The blower 162 serves to recirculate and push and pull drying air flow through the air flow assembly 150 and the treating chamber 18 upon actuation. The heating element 164 is also provided within the air flow assembly 150 to heat the drying air before it is provided to the treating chamber 18 and is positioned such that the drying air passes over the heating element 164. A drum air inlet 166 is provided at a rear portion of the treating chamber 18 and provides an outlet to the air flow assembly 150 that is fluidly coupled with the manifold assembly 200. The drum air inlet 166 comprises a tub opening 168 and a drum opening 170, which are shown in more detail in FIG. 4. The drum air inlet 166 serves to fluidly couple the blower 162 and the heating element 164 with the lifter assembly 210, the baffles 22, and the drying air outlets 152, and thus also to the treating chamber 18. The tub opening 168 and the drum opening 170 are positioned such that they can be selectively aligned with one another to fluidly couple the tub 14 and the drum 16 as the drum 16 rotates during the operation of the combination washing and drying machine 10. The drum opening 170 is in fluid communication with the lifter assembly cover 154, the lifter assembly 210, and the baffles 22, such that drying air entering through the drum opening 170 confronts the lifter assembly cover 154 and is directed into the lifter assembly 210.

Figure 4:
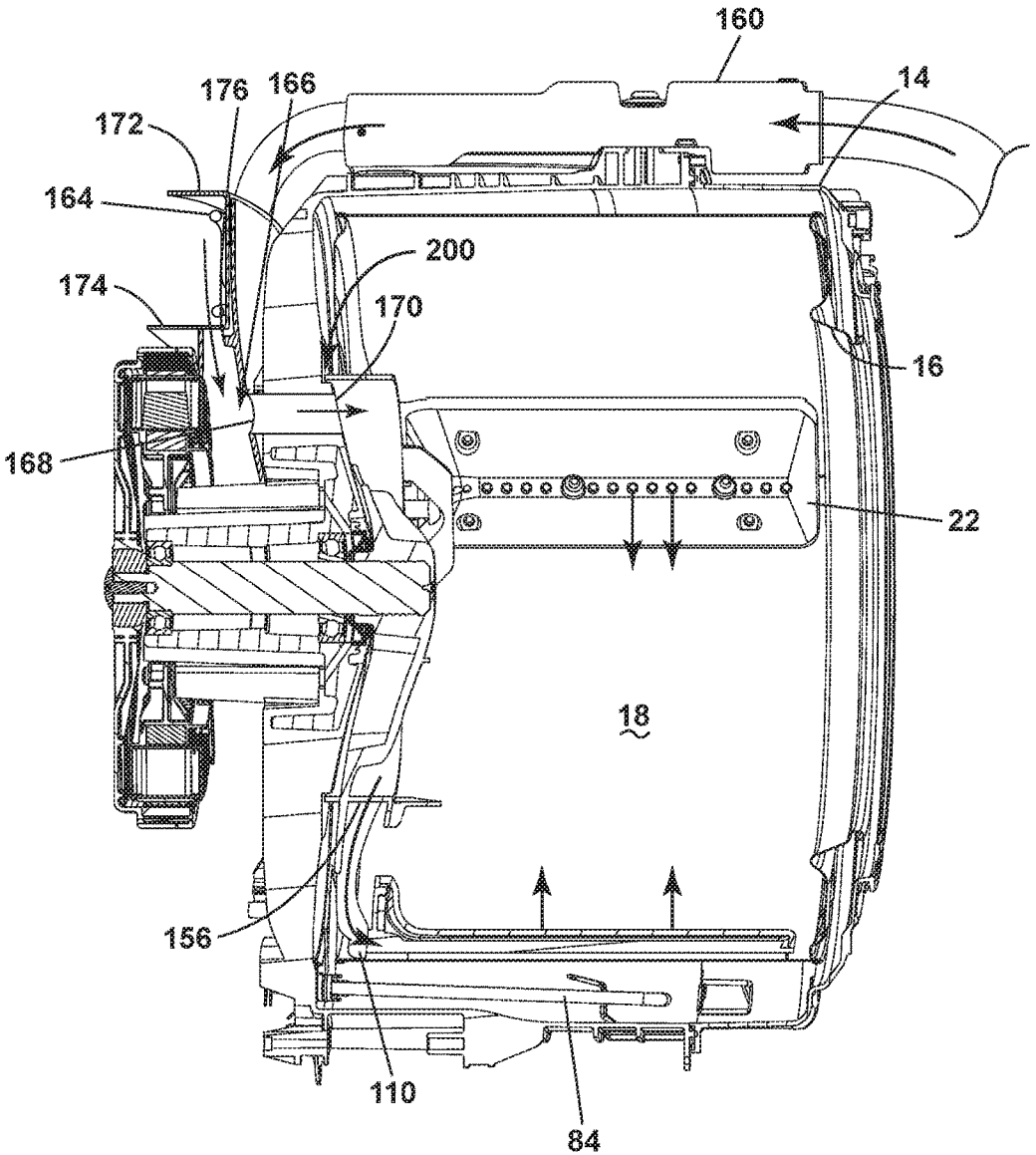
FIG. 4 illustrates an enlarged cross-sectional view of a drum air inlet and heating element for use with the air flow assembly of FIG. 3.

FIG. 4 illustrates an enlarged cross-sectional view of the drum air inlet 166 and heating element 164. With respect to the drum air inlet 166, the tub 14 includes the tub opening 168, provided within a rear surface of the tub 14. The drum opening 170 is provided within the drum rear portion 156 and can selectively align with the tub opening 168 as the drum 16 rotates. The heating element 164 can be contained within a heater housing 172. The heating element can be any suitable type of heater for warming the drying air to be provided to the treating chamber 18, non-limiting examples of which include a heating coil and a filament. The heater housing 172 defines a heater outlet 174. The heater outlet 174 can be aligned with a second tub opening 176 to allow drying air to flow from the heater housing 172 through the tub 14 and into the drum rear portion 156.

Figure 5:
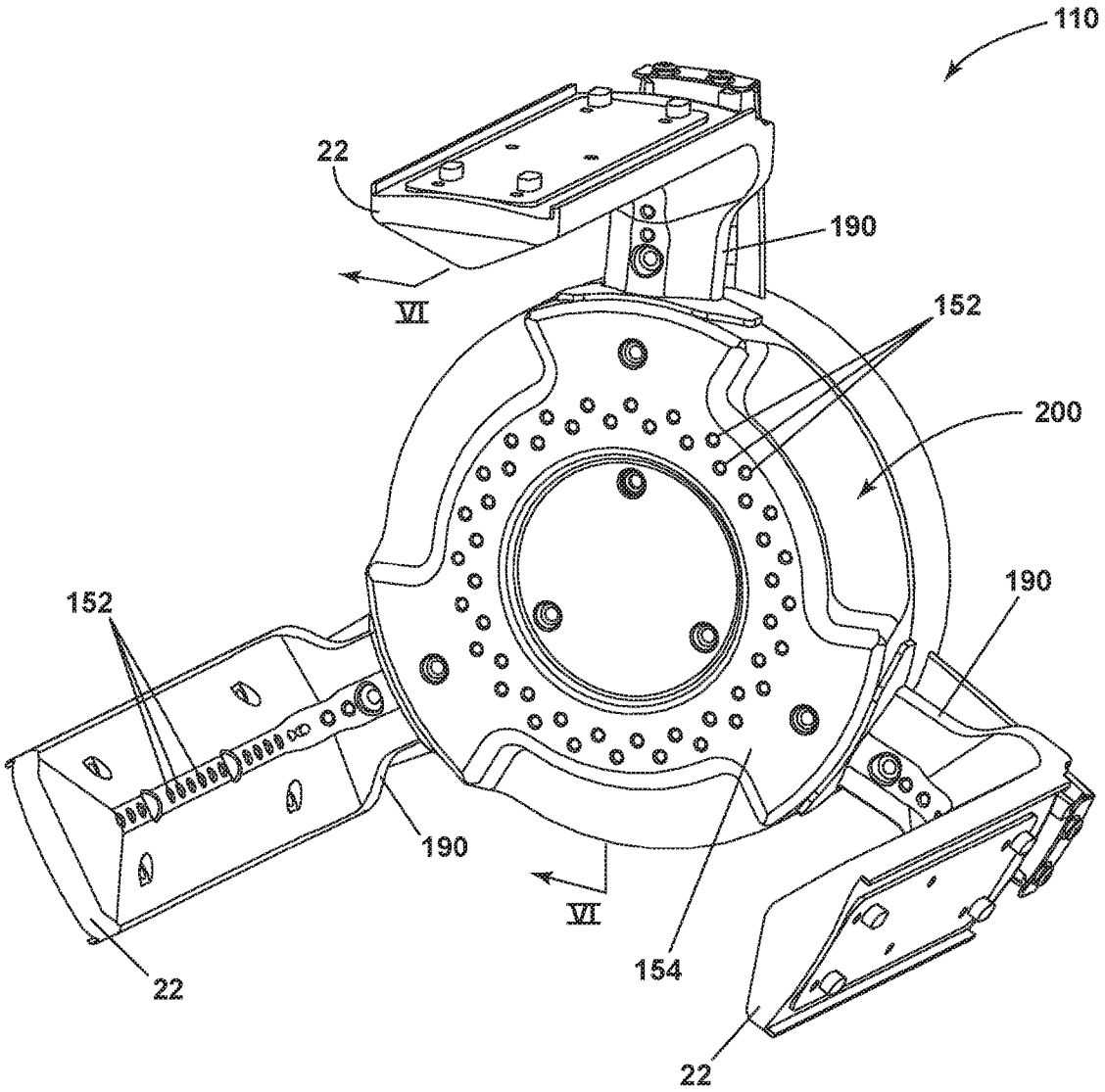
FIG. 5 illustrates a perspective view of a lifter assembly for use with the air flow assembly of FIG. 3.

FIG. 5 illustrates a perspective view of the lifter assembly 210. The lifter assembly 210 comprises at least one lifter arm 190 to fluidly couple each baffle 22 to the portion of the lifter assembly 210 that is coupled to the lifter assembly cover 154, such that the lifter assembly cover 154 is coupled to the baffles 22 via the at least one lifter arm 190. While the lifter assembly 210 is illustrated herein as having three lifter arms 190 and three baffles 22, it will be understood that any suitable number of lifter arms 190 and baffles 22 can be provided, including only a single lifter arm 190 and a single baffle 22, so long as the number of lifter arms 190 and baffles 22 are equivalent. While the baffles 22 are illustrated herein as having a generally triangular cross-sectional shape, it will be understood that any suitable cross-sectional shape can be provided, non-limiting examples of which include fin shaped, square, rounded or oval, or trapezoidal. Drying air entering the lifter assembly can enter the treating chamber 18 via the drying air outlets 152 provided on either or both of the baffles 122 and the lifter assembly cover 154.

Figure 6:
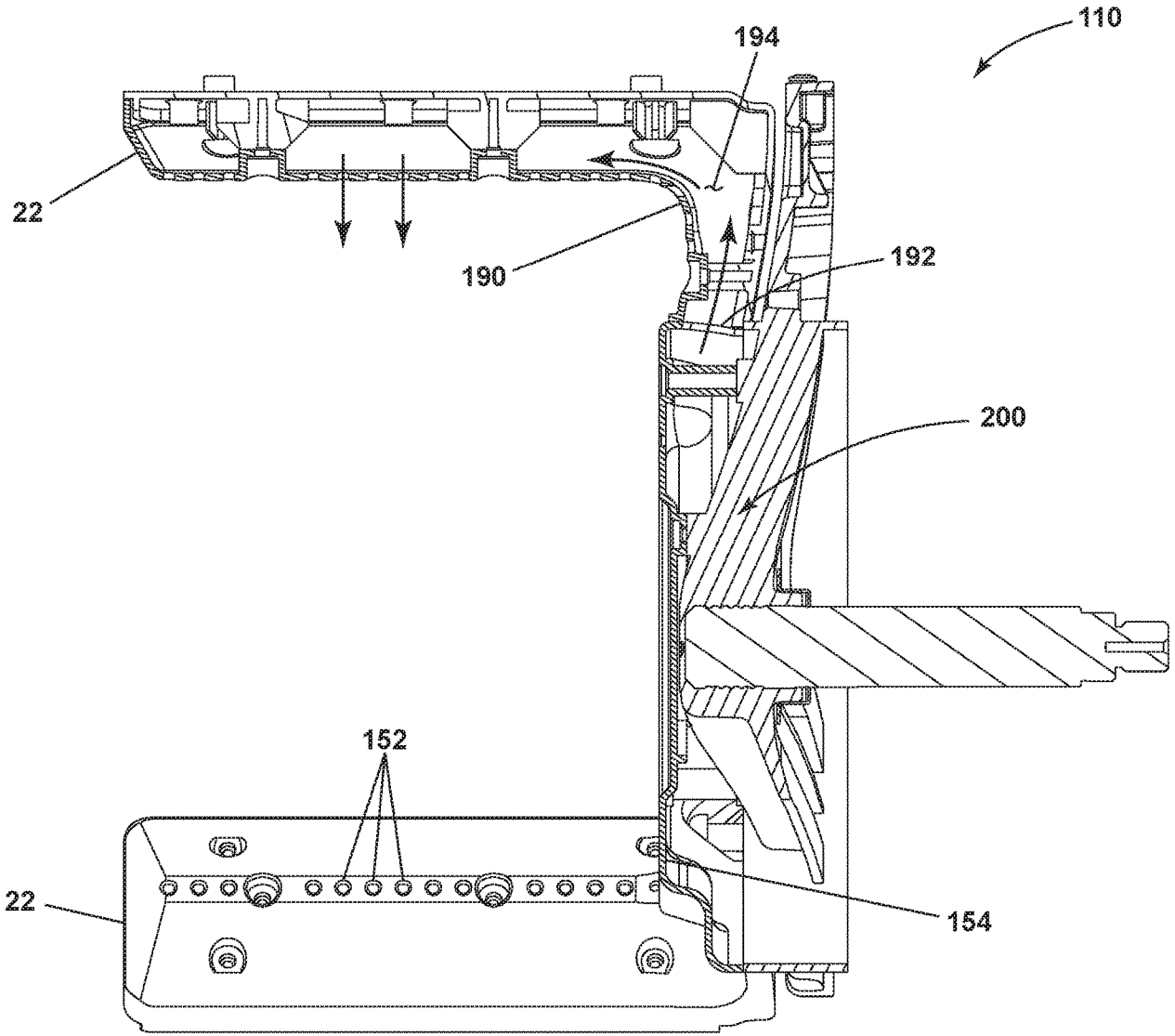
FIG. 6 illustrates a cross-sectional view of the lifter assembly of FIG. 5 in an assembled position relative to a back wall or drive plate of the drum.

FIG. 6 illustrates a cross-sectional view of the lifter assembly 210. The lifter assembly cover 154, which can serve as a manifold for the drying air, defines at least one cover outlet 192 that fluidly couples the lifter assembly cover 154 with the lifter arm 190. The lifter arm 190 is in turn fluidly coupled with the baffles 22, and thus the drying air outlets 152. At least the lifter arm 190 and the baffle 22 define a drying air outlet pathway 194 within the interior of the lifter assembly 210 that provides for the delivery of drying air from the lifter assembly cover through the lifter arm 190 to the baffle 22, where drying air can enter the treating chamber 18 via the drying air outlets 152.

Figure 7:
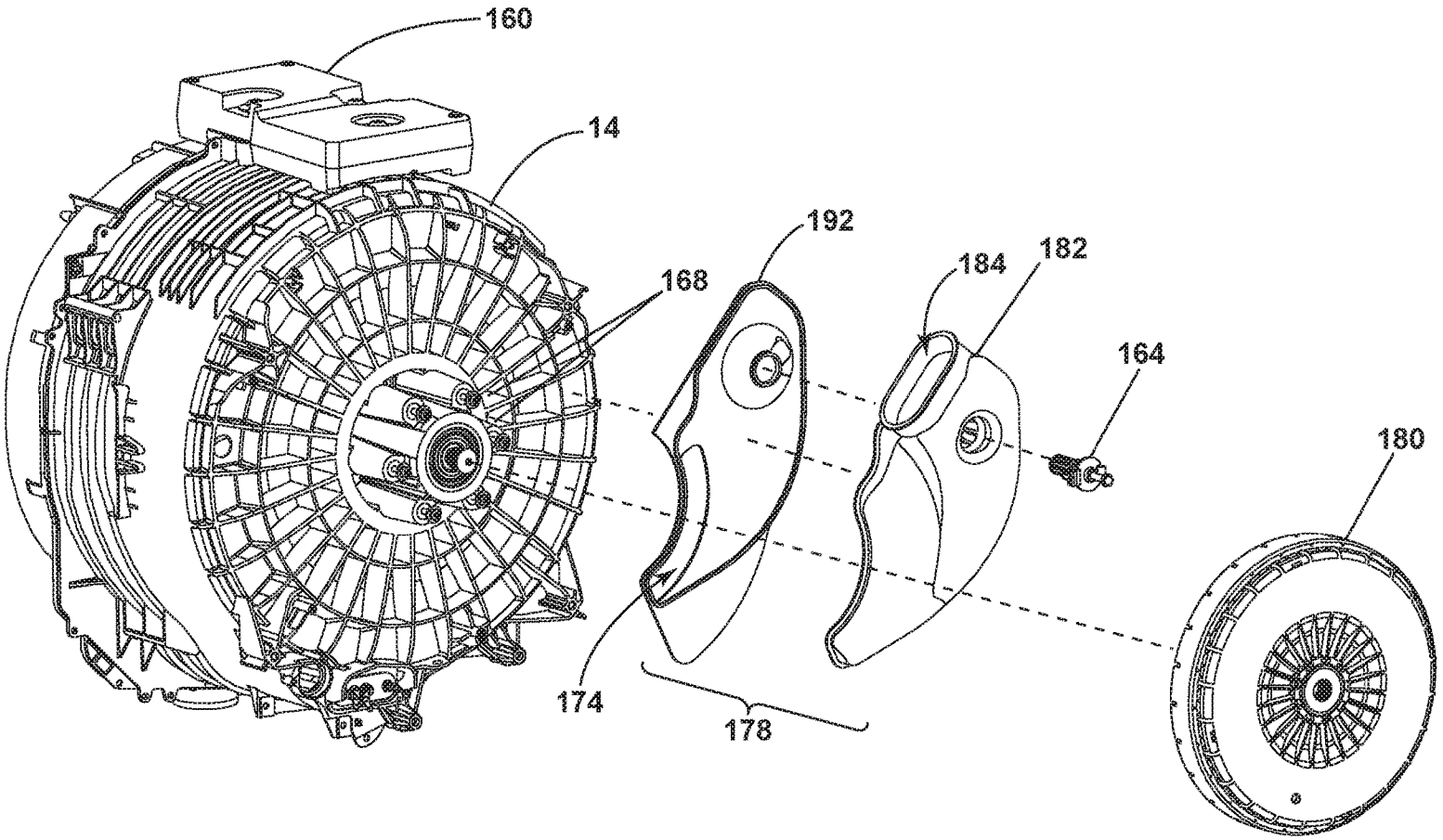
FIG. 7 illustrates an exploded rear perspective view of a tub and heating assembly for use with the air flow assembly of FIG. 3.

FIG. 7 illustrates an exploded rear perspective view of the tub 14 and a heating assembly 178. The tub openings 168 provided in the rear surface of the tub 14 fluidly couple the heating assembly 178 with the treating chamber 18 via the drum rear portion 156 and the lifter assembly 210. The heating assembly 178 is mechanically coupled with the rear surface of the tub 14 such that the heating assembly 178 overlies the tub openings 168. Specifically, the heating assembly 178 comprises the heating element 164, heater housing 172, and a heating assembly cover 182. The heater housing 172 can be generally shaped to enclose the heating element 164 and is coupled directly to the tub 14. In an exemplary aspect, the heater housing 172 can be formed from steel to protect plastic parts of the tub 14 from being directly exposed to the heating element 164. The heating assembly cover 182 can be shaped to enclose both the heating element 164, opposite the heater housing 172, as well as the tub openings 168 in order to direct drying air that enters the heating assembly 178 through the tub openings 168. In an exemplary aspect, the heating assembly cover 182 can be formed from plastic. A tub rear cover 180 can be provided to overlie the tub 14, as well as at least a portion of the heating assembly cover 182.

While the heating element 164 is illustrated herein as being provided within the heating assembly 178, it will also be understood that the heating element 164 can provided at other suitable locations within the air flow assembly 150. By way of non-limiting example, the heating element 164 can be provided within a conduit that fluidly couples the blower 162 with the heating assembly 178, or the heating element 164 can be provided integrated with or adjacent to the blower 162. In cases where the heating element 164 is provided outside the heating assembly 178, the heating assembly 178 serves as an air distribution channel.

Figure 8:
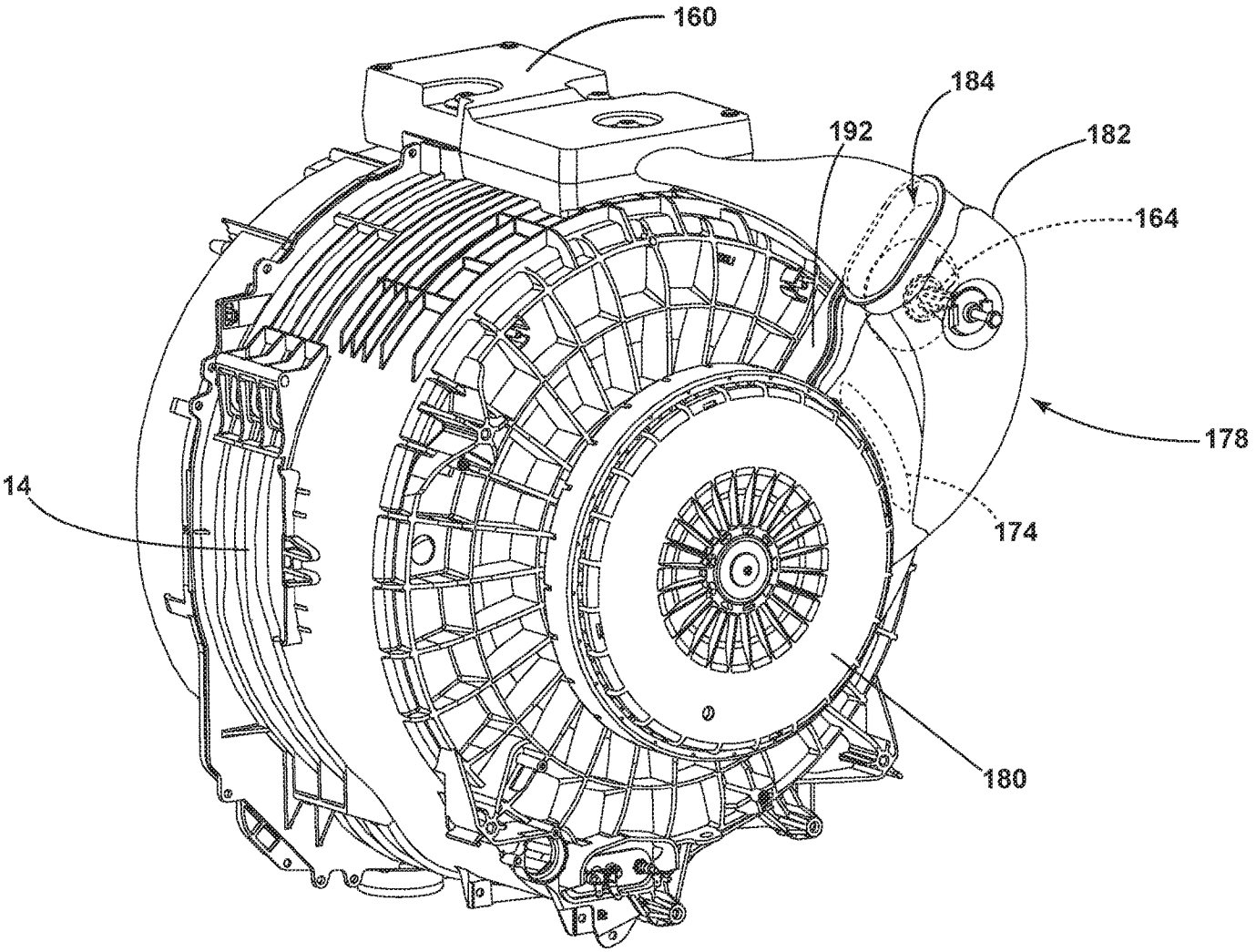
FIG. 8 illustrates a rear perspective view of the heating assembly of FIG. 6.

FIG. 8 illustrates a rear perspective view of the heating assembly 178 in an assembled position. In this view, it can be seen that the heater housing 172 includes a heater inlet 184 to receive drying air coming from the blower 162 via the air flow assembly 150. Drying air entering the heating assembly 178 via the heater inlet 184 can be selectively heated by the heating element 164. The heater outlet 174 is shown aligned with and fluidly coupled with the tub openings 168 to allow drying air to pass into the tub rear portion 156 and the lifter assembly 210.

Figure 9:
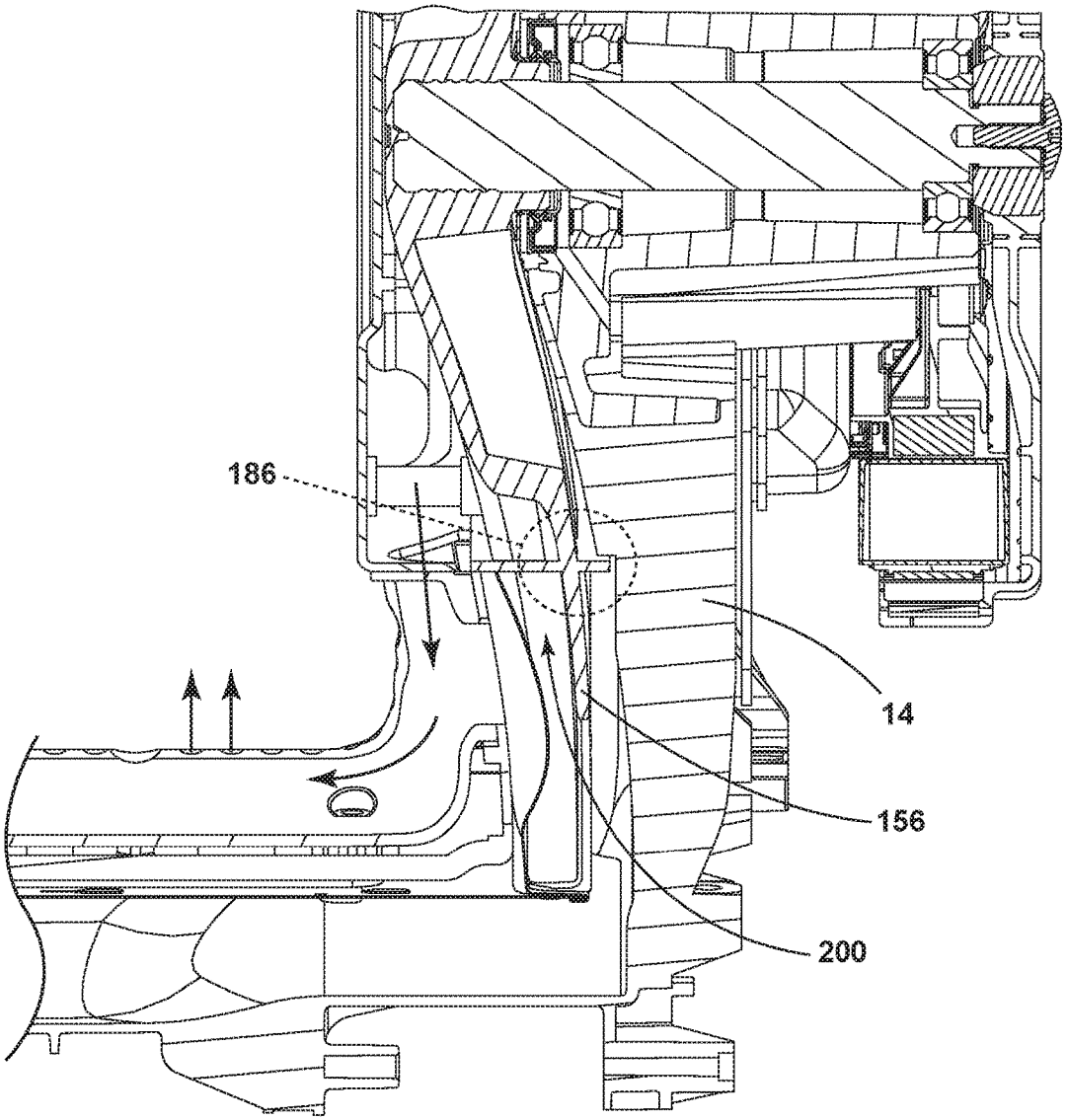
FIG. 9 illustrates an enlarged cross-sectional of an interface between the tub and a drum for use with the air flow assembly of FIG. 3.

FIG. 9 illustrates an enlarged cross-sectional view of an interface 186 between the tub 14 and the drum 16. In an exemplary aspect, the tub 14, defining the tub openings 168, is stationary and does not rotate within the combination washing and drying machine 10, while the drum 16, including the drum rear portion 156 that defines the drum opening 170, is rotatable within the tub 14. While the drum 16 is rotatable relative to the tub 14, it is still desirable to have a sealing structure between the tub 14 and the drum 16 to ensure that drying air flows from the tub openings 168 through the drum opening 170, rather than exiting between the tub 14 and the drum 16 without entering the treating chamber 18. One such type of sealing structure is to form a labyrinth seal at the interface 186, as is illustrated in FIG. 9. However, it will be understand that any suitable dynamic seal can be used such that a majority of the drying air enters the treating chamber 18. By way of non-limiting example, a sealing ring can be provided at the interface 186, or a seal that is responsive to the spin speed of the drum 16 could be included, such that the seal is tight between the drum 16 and the tub 14 at low speeds of rotation, but is drawn away from the interface 186 into a looser sealing position at higher rotational speeds.

The drum rear portion 156, serving as a manifold for the drying air, also allows the drying air that is being pushed into the treating chamber 18 by the blower 162 to stay pressurized as it comes into the treating chamber 18 through the stationary tub openings 168. This is accomplished not only by the interface 186, which can be provided as a labyrinth seal, but also by other sealing structures provided with the drum rear portion 156. By way of non-limiting example, the drum rear portion 156 can include protrusions that project toward the tub 14 to prevent loss of drying air and loss of air pressure by minimizing the gap between the tub 14 and the drum 16. Additionally, or alternatively, the interface 186 can be a labyrinth seal with additional ribs, forming multiple labyrinth seals. At least one rib can also be provided to ensure that liquid present during washing cycles cannot reach the labyrinth seals.

Turning now to the operation of the air flow assembly 150, the blower 162 pushes drying air into the heating assembly 178 via the heater inlet 184, where the drying air can be selectively heated before it is provided to the treating chamber 18. Drying air then exits the heating assembly 178 via the heater outlet 174, then enters the tub 14 via the second tub opening 176. Drying air flows from the second tub opening 176 to the tub opening 168, then into the drum rear portion 156 via the drum opening 170. From the drum rear portion 156, the drying air enters the lifter assembly 210 and exits the lifter assembly 210 via drying air outlets 156 on either or both of the lifter assembly cover 154 or the baffles 22 to enter the treating chamber 18. When the drying air has entered the treating chamber 18, moisture from the laundry items is absorbed by the drying air, causing the drying air to become wet air as it moves through the treating chamber 18 and towards the bellows 26. Due to the suction created in the air flow assembly 150 by the blower 162, the wet air is drawn out of the treating chamber 18 via the drum air outlet 158, where it then flows into the condenser 160. In the condenser 160, moisture is condensed out of the wet air such that the wet air again becomes drying air. The drying air is then moved by the blower 162 back into the heating assembly 178 to begin the pathway through the air flow assembly 150 again.

The aspects disclosed herein provide an air flow assembly that can improve drying performance within a combination washing and drying machine. By moving the drying air from the rear of the treating chamber and through the lifters, then out through the bellows, drying air is distributed evenly throughout the treating chamber for improved drying performance over traditional combination washing and drying machines. This can result in improvement in drying efficiency, reduction of cycle time, and reduction of energy consumption by the combination washing and drying machine. Furthermore, the aspects described herein provide a solution that allows for air flow through the rear of the tub and the drum without loss of tub stiffness. Allowing for improved drying performance while maintaining sufficient rear tub stiffness is accomplished with the structure disclosed herein.

To the extent not already described, the different features and structures of the various aspects can be used in combination with each other as desired, or can be used separately. That one feature may not be illustrated in all of the aspects is not meant to be construed that it cannot be, but is done for brevity of description. Thus, the various features of the different aspects can be mixed and matched as desired to form new aspects, whether or not the new aspects are expressly described.

While the present disclosure has been specifically described in connection with certain specific aspects thereof, it is to be understood that this is by way of illustration and not of limitation. Reasonable variation and modification are possible within the scope of the forgoing disclosure and drawings without departing from the spirit of the present disclosure. Hence, specific dimensions and other physical characteristics relating to the aspects disclosed herein are not to be considered as limiting, unless expressly stated otherwise.

What is claimed is:

1. A combination washing and drying treating appliance for treating laundry according to an automatic cycle of operation, the combination laundry treating appliance comprising:

a cabinet defining a cabinet interior;

a tub defining a tub interior for receiving wash liquid during a washing cycle of operation;

a drum, rotatable within the tub interior, defining a treating chamber for holding laundry for washing or drying treatment and having at least one baffle with a plurality of air outlets;

a washing circuit comprising:

a treating chemistry dispenser fluidly coupled to at least one of the tub interior or drum interior; and a liquid supply fluidly coupled to at least one of the treating chemistry dispenser, tub interior or drum interior; and a drying air circuit comprising:

a manifold assembly provided on a rear of the drum;

a lifter assembly provided on the drum and fluidly coupling the manifold assembly to the plurality of air outlets on the baffle;

an air flow assembly having an inlet located at a front of the treating chamber and an outlet fluidly coupled to the manifold assembly; and a blower fluidly coupled to the air flow assembly whereby actuation of the blower recirculates air through the treating chamber by flowing air from the front of the treating chamber through the inlet and back to the manifold assembly, where the air is returned to the treating chamber at least through the air outlets in the baffle to establish a front-to-back recirculation of air within the treating chamber.

2. The laundry treating appliance of claim 1 further comprising:

a tub opening within a rear surface of the tub; and a drum opening within the rear of the drum that is at least partially aligned with the tub opening;

wherein the air flow assembly outlet passes through the tub and drum openings.

3. The laundry treating appliance of claim 1 wherein the lifter assembly is disposed on an inner surface of the drum.

4. The laundry treating appliance of claim 1 wherein the lifter assembly comprises the at least one baffle.

5. The laundry treating appliance of claim 2 wherein the air flow assembly further comprises an interface between the tub opening and the drum opening.

6. The laundry treating appliance of claim 5 wherein the interface between the tub opening and the drum opening comprises a dynamic seal between the tub opening and the drum opening.

7. The laundry treating appliance of claim 5 wherein the interface between the tub opening and the drum opening comprises at least one labyrinth seal at the interface.

8. The laundry treating appliance of claim 5 wherein the manifold assembly comprises the interface between the tub opening and the drum opening.

9. The laundry treating appliance of claim 8 wherein the manifold assembly comprises the rear of the drum and a portion of the lifter assembly.

10. The laundry treating appliance of claim 8 wherein the lifter assembly includes a lifter assembly cover and the manifold assembly comprises a drum rear portion and the lifter assembly cover.

11. The laundry treating appliance of claim 10 wherein the lifter assembly cover includes air outlets.

12. The laundry treating appliance of claim 1 wherein at least a portion of the air flow assembly is adjacent an upper portion of the tub.

13. The laundry treating appliance of claim 1 wherein the air flow assembly further comprises at least one of the blower, a condenser, and a heating element.

14. The laundry treating appliance of claim 13 wherein the air flow assembly further comprises the condenser, with the condenser fluidly coupled to the air flow assembly inlet.

15. The laundry treating appliance of claim 14 wherein air within the air flow assembly can flow from the air flow assembly inlet to the condenser, then to the blower, then to the air flow assembly outlet.

16. The laundry treating appliance of claim 13 wherein at least one of the blower, the condenser, or the heating element are adjacent an upper portion of the tub.

17. The laundry treating appliance of claim 1 wherein the air flow assembly is configured to provide drying air into the treating chamber for drying the laundry.

18. The laundry treating appliance of claim 1 wherein a bellows couples an open face of the tub with the cabinet.

19. The laundry treating appliance of claim 18 wherein a drum air outlet is provided within the bellows.

20. The laundry treating appliance of claim 19 wherein the air flow assembly inlet comprises the drum air outlet.

* * * * *